US009239050B2

(12) United States Patent
Akatsuka et al.

(10) Patent No.: US 9,239,050 B2
(45) Date of Patent: Jan. 19, 2016

(54) VANE PUMP

(75) Inventors: Koichiro Akatsuka, Gifu (JP); Ryuji Naide, Kishiwada (JP)

(73) Assignee: KAYABA INDUSTRY CO., LTD., Tokyo (JP)

( * ) Notice: Subject to any disclaimer, the term of this patent is extended or adjusted under 35 U.S.C. 154(b) by 0 days.

(21) Appl. No.: 13/821,486

(22) PCT Filed: Oct. 20, 2011

(86) PCT No.: PCT/JP2011/074149

§ 371 (c)(1),
(2), (4) Date: Mar. 7, 2013

(87) PCT Pub. No.: WO2012/053588

PCT Pub. Date: Apr. 26, 2012

(65) Prior Publication Data

US 2013/0280118 A1 Oct. 24, 2013

(30) Foreign Application Priority Data

Oct. 22, 2010 (JP) ..... 2010-237920

(51) Int. Cl.
*F04C 2/00* (2006.01)
*F01C 21/08* (2006.01)
*F04C 2/344* (2006.01)

(52) U.S. Cl.
CPC ..... *F04C 2/00* (2013.01); *F01C 21/0863* (2013.01); *F04C 2/3446* (2013.01)

(58) Field of Classification Search
CPC .... F04C 2/3446; F04C 2/344; F04C 15/0049; F04C 15/0023; F04C 15/0042; F01C 21/0863; F01C 21/0908
USPC ..... 418/80, 77, 81, 82, 133, 180, 268–269, 418/259
See application file for complete search history.

(56) References Cited

U.S. PATENT DOCUMENTS 2,962,973 A * 12/1960 Pettibone ..... F01C 21/0863 418/133
4,386,891 A * 6/1983 Riefel et al. ..... 418/81
(Continued)

FOREIGN PATENT DOCUMENTS

JP 57-054693 A 3/1982
JP 2-090378 U 7/1990
(Continued)

OTHER PUBLICATIONS

International Search Report and Written Opinion corresponding to PCT/JP2012/074149, dated Jan. 24, 2012.

*Primary Examiner* — Jorge Pereiro
*Assistant Examiner* — Jason T Newton
(74) *Attorney, Agent, or Firm* — Hauptman Ham, LLP

(57) ABSTRACT

A vane pump including a cam ring, a rotor, slits formed in the rotor, vanes inserted slidably into the slits, pump chambers defined by the vanes, back pressure chambers defined between respective base end portions of the vanes and the slits, back pressure grooves capable of communicating with the back pressure chambers as the rotor rotates, and connecting grooves connecting back pressure grooves that are adjacent in a circumferential direction of the rotor to each other, wherein a connecting groove that communicates with a back pressure groove positioned in a suction region formed above a rotary center of the rotor so as to suction a working fluid into the pump chambers is formed to have a larger passage sectional area than a connecting groove that communicates with another back pressure groove positioned in another suction region formed below the rotary center of the rotor.

5 Claims, 6 Drawing Sheets

(56) References Cited

U.S. PATENT DOCUMENTS

| | | | | |
|---|---|---|---|---|
| 5,188,522 | A * | 2/1993 | Hara | F01C 21/0863 418/212 |
| 6,203,303 | B1 * | 3/2001 | Fujiwara et al. | 418/269 |
| 6,244,830 | B1 * | 6/2001 | Agner | F01C 21/0863 417/204 |
| 2004/0202565 | A1 * | 10/2004 | Yao et al. | 418/268 |
| 2005/0036897 | A1 * | 2/2005 | Kasmer | F01C 21/0863 418/259 |
| 2010/0329917 | A1 * | 12/2010 | Ando | F01C 21/0863 418/133 |

FOREIGN PATENT DOCUMENTS

| | | | |
|---|---|---|---|
| JP | 11-230057 | A | 8/1999 |
| JP | 2003-184759 | A | 7/2003 |
| JP | 2004-308605 | A | 11/2004 |

* cited by examiner

VANE PUMP

FIELD OF THE INVENTION

This invention relates to a vane pump used as a fluid pressure supply source.

BACKGROUND OF THE INVENTION

In a vane pump, a plurality of vanes are housed in radial slits formed in a rotor. Each vane is biased in a projecting direction from the slit by a pressure of a back pressure chamber that presses a base end portion of the vane and a centrifugal force acting thereon as the rotor rotates, and as a result, a tip end portion of the vane slides against an inner peripheral cam surface of a cam ring. As the rotor rotates, the vane sliding against the cam surface performs a reciprocating motion such that a pump chamber expands and contracts, and as a result, working oil is supplied to and discharged from the pump chamber.

JP11-230057A proposes a vane pump in which back pressure grooves communicating with a back pressure chamber and connecting grooves connecting the respective back pressure grooves are formed in front and rear pressure plates provided to sandwich a rotor and respective vanes. In this vane pump, the connecting grooves formed in the front pressure plate are shaped differently to the connecting grooves formed in the rear pressure plate. According to this vane pump, a sealing performance of the pump chamber can be improved.

SUMMARY OF THE INVENTION

When this type of conventional vane pump is left in a stopped condition continuously, however, gravity may cause the vanes projecting upward from the rotor to retreat into the slits. As a result, a large amount of time may be required for the vanes that have retreated into the slits to project from the slits when the vane pump is activated, leading to a delay in a rise of a pump discharge pressure.

An object of this invention is to ensure that a pump discharge pressure of a vane pump rises quickly.

To achieve the above object, this invention provides a vane pump used as a fluid pressure supply source. The vane pump includes a cam ring having a cam surface formed on an inner periphery thereof, a rotor provided on the inner periphery of the cam ring and driven to rotate relative to the cam ring, a plurality of slits formed in a radial shape in an outer periphery of the rotor, a plurality of vanes inserted slidably into the slits such that respective tip end portions thereof can slide against the cam surface, a plurality of pump chambers defined between the cam surface and the rotor by the vanes, a plurality of back pressure chambers defined between respective base end portions of the vanes and the slits to be capable of biasing the vanes toward the cam surface, a plurality of back pressure grooves capable of communicating with the back pressure chambers as the rotor rotates, and a plurality of connecting grooves connecting back pressure grooves that are adjacent in a circumferential direction of the rotor to each other, wherein a connecting groove that communicates with a back pressure groove positioned in a suction region formed above a rotary center of the rotor so as to suction a working fluid into the pump chambers is formed to have a larger passage sectional area than a connecting groove that communicates with another back pressure groove positioned in another suction region formed below the rotary center of the rotor.

The details as well as other features and advantages of this invention are set forth in the remainder of the specification and are shown in the accompanying drawings.

DESCRIPTION OF THE PREFERRED EMBODIMENTS

A vane pump 1 according to an embodiment of this invention will be described below with reference to the figures.

Figure 1:
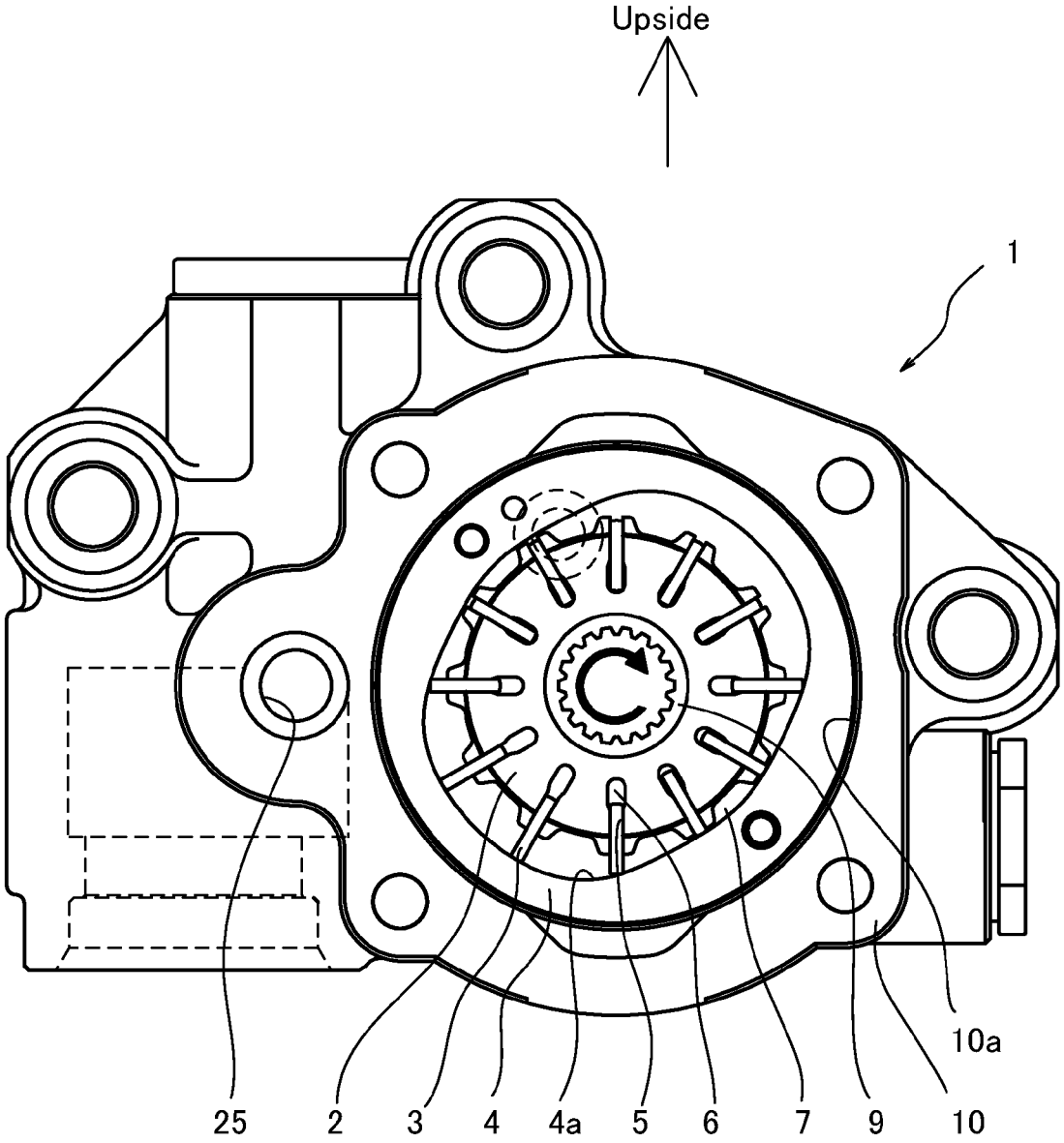
FIG. 1 is a front view showing a condition in which a pump cover of a vane pump according to an embodiment of this invention is removed.

First, referring to FIG. 1, a configuration of the vane pump 1 will be described.

The vane pump 1 is used in a hydraulic device installed in a vehicle. For example, the vane pump 1 is used as an oil pressure supply source for a power steering device, a transmission, or the like.

The vane pump 1 uses working oil as a working fluid. Instead of working oil, a working fluid such as an aqueous replacement fluid, for example, may be used as the working fluid.

The vane pump 1 includes a pump body 10 formed with a pump housing recess portion 10*a* housing a rotor 2, a cam ring 4, a side plate 30, and so on, and a pump cover 50 that is fastened to the pump body 10 so as to seal the pump housing recess portion 10*a*.

In the vane pump 1, power is transmitted from an engine, not shown in the figure, to an end portion of a drive shaft 9, whereby the rotor 2, which is coupled to the drive shaft 9, is driven to rotate. The rotor 2 rotates in a direction indicated by arrows in FIGS. 1 to 3. The drive shaft 9 is supported to be free to rotate by the pump body 10 and the pump cover 50.

A high pressure chamber, not shown in the figure, is defined between a bottom portion of the pump housing recess portion 10*a* of the pump body 10 and the side plate 30. The side plate 30 is pressed against a rear side end surface of the cam ring 4 by a pump discharge pressure led to the high pressure chamber.

The vane pump 1 includes a plurality of vanes 3 provided to be free to reciprocate in a radial direction relative to the rotor 2, and the cam ring 4, which houses the rotor 2 and the vanes 3 and along which tip end portions of the vanes 3 slide as the rotor 2 rotates.

The rotor 2 is provided on an inner periphery of the cam ring 4. A plurality of slits 5 having an opening portion in an outer peripheral surface thereof are formed in a radial shape at predetermined intervals in the rotor 2. The vanes 3 are formed in a rectangular plate shape. The vanes 3 are inserted slidably into the slits 5 such that the tip end portions thereof can slide against the cam surface 4*a*.

A plurality of pump chambers 7 are defined in the interior of the cam ring 4 by an outer peripheral surface of the rotor 2, the cam surface 4*a* of the cam ring, and adjacent vanes 3.

The cam ring 4 is a ring-shaped member having the cam surface 4*a*, which is formed in a substantially elliptical shape, on an inner periphery thereof. The cam surface 4*a* is formed such that for each revolution of the rotor 2, the respective vanes 3 following the cam surface 4*a* reciprocate twice.

Figure 2:
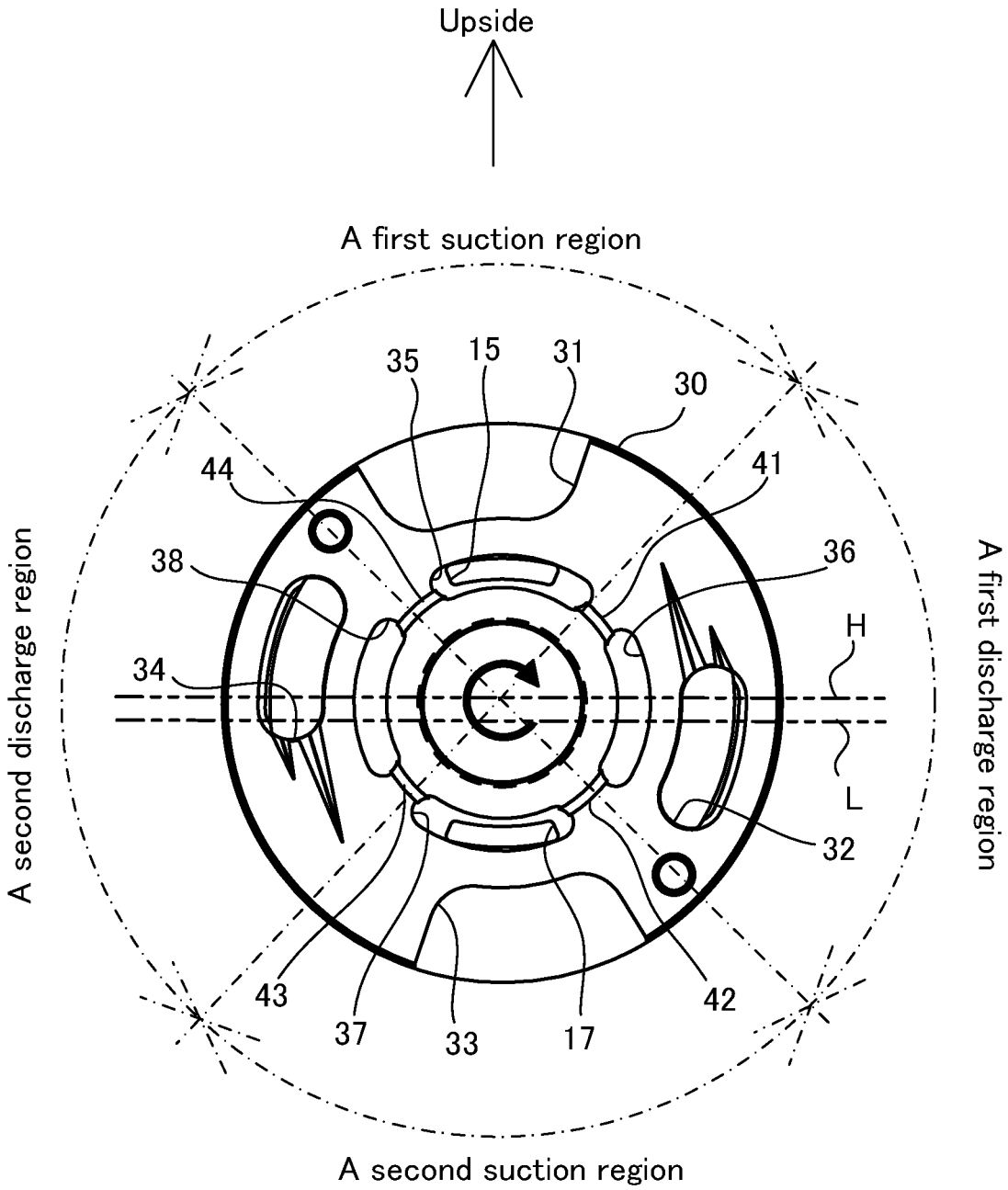
FIG. 2 is a front view showing a side plate of the vane pump according to this embodiment of the invention.
Figure 3:
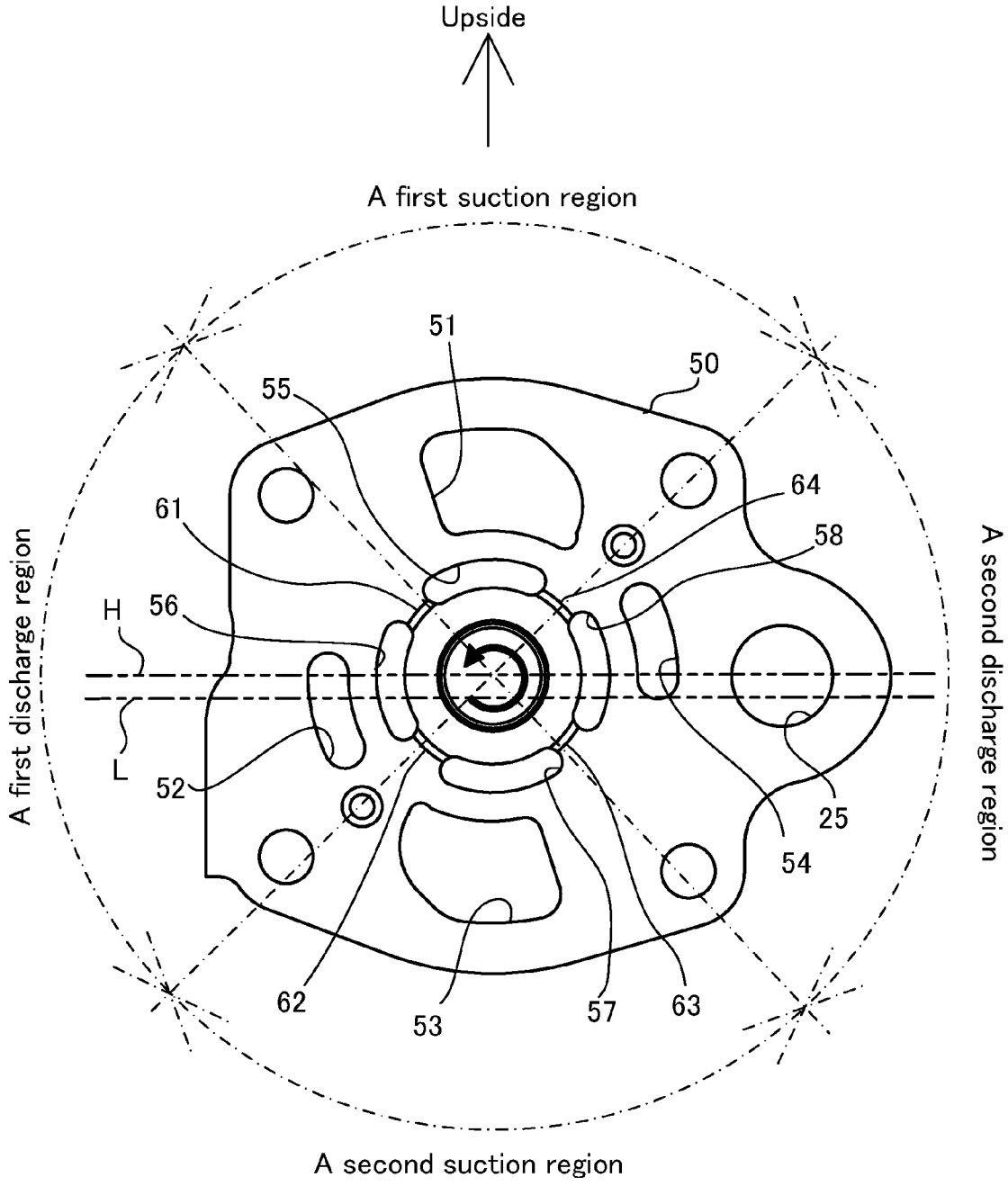
FIG. 3 is a front view showing the pump cover of the vane pump according to this embodiment of the invention.
Figure 4:
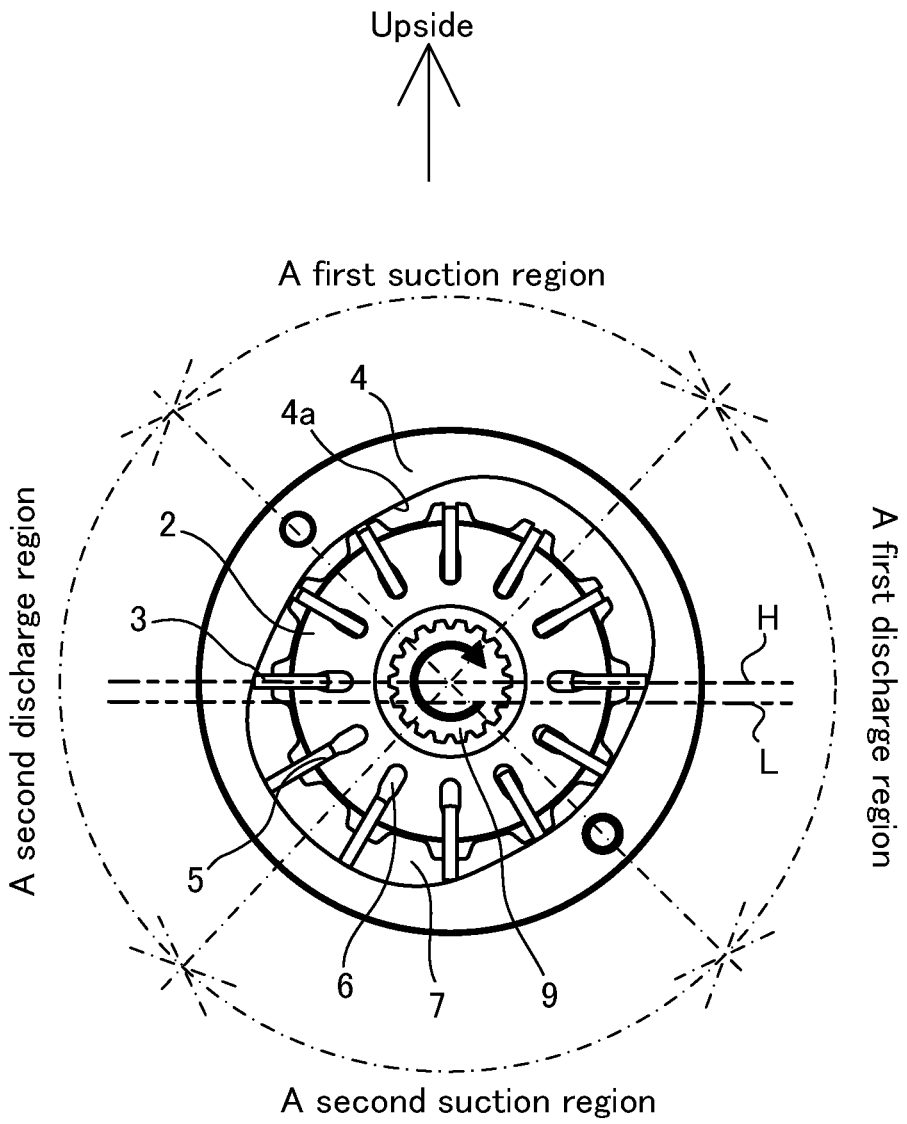
FIG. 4 is a front view showing a condition inside a cam ring when the vane pump according to this embodiment of the invention is stopped.

As shown in FIGS. 2 to 4, the vane pump 1 includes a first region in which the vanes 3 perform a first reciprocation and a second region in which the vanes 3 perform a second reciprocation.

The first region includes a first suction region in which a volume of the pump chamber 7 defined between the vanes 3 that slide along the cam surface 4*a* as the rotor 2 rotates expands such that working oil is suctioned into the pump chamber 7, and a first discharge region in which the volume of the pump chamber 7 contracts such that the working oil in the pump chamber 7 is discharged.

Similarly, the second region includes a second suction region in which the volume of the pump chamber 7 defined between the vanes 3 that slide along the cam surface 4*a* as the rotor 2 rotates expands such that working oil is suctioned into the pump chamber 7, and a second discharge region in which the volume of the pump chamber 7 contracts such that the working oil in the pump chamber 7 is discharged.

Hence, the vane pump 1 includes two suction regions and two discharge regions. The vane pump 1 is not limited to this configuration, however, and may include three or more suction regions and three or more discharge regions.

On a front side end surface of the pump cover 50 against which the rotor 2 slides, a first suction port 51 opens into the first suction region, a first discharge port 52 opens into the first discharge region, a second suction port 53 opens into the second suction region, and a second discharge port 54 opens into the second discharge region.

The first suction port 51 and the second suction port 53 communicate with a tank, not shown in the figures, via a suction passage 25. Working oil is led from the tank to the first suction port 51 and the second suction port 53.

As shown in FIG. 2, on a rear side end surface of the side plate 30 against which the rotor 2 slides, a first suction port 31 opens into the first suction region, a first discharge port 32 opens into the first discharge region, a second suction port 33 opens into the second suction region, and a second discharge port 34 opens into the second discharge region.

The first discharge port 32 and the second discharge port 34 communicate with a hydraulic device via a pump discharge passage, not shown in the figures. Pressurized working oil discharged from the first discharge port 32 and the second discharge port 34 is thus supplied to the hydraulic device.

A back pressure chamber 6 capable of biasing the vane 3 toward the cam surface 4*a* is defined on a back side of each slit 5 relative to a base end portion of each vane 3. The vane 3 is biased in a projecting direction from the slit 5 by a pressure of the back pressure chamber 6 pressing against the base end portion of the vane 3 and a centrifugal force acting on the vane 3 as the rotor 2 rotates. As a result, the tip end portion of the vane 3 slides against the cam surface 4*a* of the cam ring 4.

As shown in FIG. 2, a first suction side back pressure groove 35, a first discharge side back pressure groove 36, a second suction side back pressure groove 37, and a second discharge side back pressure groove 38 are formed in an arc shape and arranged in series in the end surface of the side plate 30 against which the rotor 2 slides. The first suction side back pressure groove 35, first discharge side back pressure groove 36, second suction side back pressure groove 37, and second discharge side back pressure groove 38 are capable of communicating with the back pressure chambers 6 as the rotor 2 rotates.

Furthermore, a first connecting groove 41 that connects the first suction side back pressure groove 35 and the first discharge side back pressure groove 36, a second connecting groove 42 that connects the first discharge side back pressure groove 36 and the second suction side back pressure groove 37, a third connecting groove 43 that connects the second suction side back pressure groove 37 and the second discharge side back pressure groove 38, and a fourth connecting groove 44 that connects the second discharge side back pressure groove 38 and the first suction side back pressure groove 35 are formed in an arc shape and arranged in series in the end surface of the side plate 30 against which the rotor 2 slides.

The first suction side back pressure groove 35 opens into the first suction region. The first discharge side back pressure groove 36 opens into the first discharge region. The second suction side back pressure groove 37 opens into the second suction region. The second discharge side back pressure groove 38 opens into the second discharge region.

The first suction side back pressure groove 35 communicates with the high pressure chamber via a high pressure chamber connecting hole 15. The second suction side back pressure groove 37 communicates with the high pressure chamber via a high pressure chamber connecting hole 17. As a result, the pump discharge pressure is led from the high pressure chamber into the first suction side back pressure groove 35 and the second suction side back pressure groove 37. The pump discharge pressure is then led into the respective back pressure chambers 6 opposing the first suction side back pressure groove 35 and the second suction side back pressure groove 37. The base end portions of the vanes 3 positioned in the first suction region and the second suction region are therefore pressed by the pump discharge pressure led into the respective back pressure chambers 6.

Further, the pump discharge pressure is led into the first discharge side back pressure groove 36 and the second discharge side back pressure groove 38 via the first connecting groove 41, the second connecting groove 42, the third connecting groove 43, and the fourth connecting groove 44. The pump discharge pressure is then led into the respective back pressure chambers 6 opposing the first discharge side back pressure groove 36 and the second discharge side back pressure groove 38. The base end portions of the vanes 3 positioned in the first discharge region and the second discharge region are therefore likewise pressed by the pump discharge pressure led into the respective back pressure chambers 6.

Respective passage lengths of the first connecting groove 41, the second connecting groove 42, the third connecting groove 43, and the fourth connecting groove 44 are set to be substantially equal.

As shown in FIG. 3, a first suction side back pressure groove 55, a first discharge side back pressure groove 56, a second suction side back pressure groove 57, and a second discharge side back pressure groove 58 are formed in an arc shape and arranged in series in the end surface of the pump cover 50 against which the rotor 2 slides. The first suction side back pressure groove 55, first discharge side back pressure groove 56, second suction side back pressure groove 57, and second discharge side back pressure groove 58 are capable of communicating with the back pressure chambers 6 as the rotor 2 rotates.

Further, a first connecting groove 61 that connects the first suction side back pressure groove 55 and the first discharge side back pressure groove 56, a second connecting groove 62 that connects the first discharge side back pressure groove 56 and the second suction side back pressure groove 57, a third connecting groove 63 that connects the second suction side back pressure groove 57 and the second discharge side back pressure groove 58, and a fourth connecting groove 64 that connects the second discharge side back pressure groove 58 and the first suction side back pressure groove 55 are formed in an arc shape and arranged in series in the end surface of the pump cover 50 against which the rotor 2 slides.

The first suction side back pressure groove 55 opens into the first suction region. The first discharge side back pressure groove 56 opens into the first discharge region. The second suction side back pressure groove 57 opens into the second suction region. The second discharge side back pressure groove 58 opens into the second discharge region.

Respective passage lengths of the first connecting groove 61, the second connecting groove 62, the third connecting groove 63, and the fourth connecting groove 64 are set to be substantially equal.

When the vane pump 1 is operated, the respective vanes 3 reciprocate while following the cam surface 4*a*. The volume of each back pressure chamber 6 expands and contracts in accordance with the reciprocating motion of the vanes 3. A pump operation produced by the expansion and contraction of the back pressure chambers 6 causes the working oil to flow so as to circulate between the respective back pressure chambers 6 and the first suction side back pressure grooves 35, 55, the first discharge side back pressure grooves 36, 56, the second suction side back pressure grooves 37, 57, and the second discharge side back pressure grooves 38, 58 through the first connecting grooves 41, 61, second connecting grooves 42, 62, third connecting grooves 43, 63, and fourth connecting grooves 44, 64.

The vane pump 1 shown in FIGS. 1 to 4 is installed in an orientation whereby the first suction region formed with the first suction side back pressure grooves 35, 55 is positioned above the second suction region formed with the second suction side back pressure grooves 37, 57 in the direction of an arrow in the figures.

Here, when the vane pump 1 is left in a stopped condition continuously, a part of the working oil existing in the vane pump 1 flows down through the suction passage 25 into the tank. As a result, only residual working oil that does not flow down into the tank remains in the vane pump 1. In FIG. 4, an oil level line L extending horizontally indicates an oil level position of the working oil remaining in the vane pump 1 when the vane pump 1 is stopped.

As shown in FIG. 4, when the vane pump 1 is stopped, gravity causes all of the vanes 3 positioned in the first suction region and a part of the vanes 3 positioned in the first discharge region to retreat into the corresponding slits 5.

Hence, when the vane pump 1 is subsequently activated, an operation for causing the vanes 3 that have retreated into the corresponding slits 5 to project from the slits 5 may take a long time, leading to a delay in the rise of the pump discharge pressure.

In this invention, however, a magnitude relationship between respective passage resistance values of the first connecting groove 61, the second connecting groove 62, the third connecting groove 63, and the fourth connecting groove 64 formed in the pump cover 50 is set in a manner to be described below. In so doing, a pressure in the first suction side back pressure groove 55 can be increased earlier using a pump operation for pushing out the working oil by pressing the respective vanes 3 in the first discharge region or the second discharge region into the slits 5 as the vanes 3 follow the cam surface 4*a* such that the respective back pressure chambers 6 decrease in volume. As a result, the vanes 3 that have retreated into the slits 5 can be caused to project quickly.

The passage resistance of the first connecting groove 61, second connecting groove 62, third connecting groove 63, and fourth connecting groove 64 can be adjusted by adjusting the magnitude of a passage sectional area between the grooves and a front side end surface of the rotor 2. The passage sectional area can be adjusted by adjusting at least one of an opening width and a depth of the grooves.

It should be noted that the passage resistance of the first connecting groove 61, second connecting groove 62, third connecting groove 63, and fourth connecting groove 64 can also be adjusted by adjusting a length of the passage defined between the grooves and the front side end surface of the rotor 2.

Respective passage resistance values of the first connecting groove 41, the second connecting groove 42, the third connecting groove 43, and the fourth connecting groove 44 formed in the side plate 30, meanwhile, are set to be substantially equal. The passage resistance values of the first connecting groove 41, the second connecting groove 42, the third connecting groove 43, and the fourth connecting groove 44 are not limited thereto, however, and may be set similarly to a magnitude relationship between passage resistance values of the first connecting groove 61, the second connecting groove 62, the third connecting groove 63, and the fourth connecting groove 64 formed in the pump cover 50, as will be described below. Likewise in this case, the pressure in the first suction side back pressure groove 55 can be increased earlier using the pump operation for pushing out the working oil by pressing the respective vanes 3 in the first discharge region or the second discharge region into the slits 5 such that the respective back pressure chambers 6 decrease in volume. As a result, the vanes 3 that have retreated into the slits 5 can be caused to project quickly.

In this invention, the passage sectional area of at least one of the first connecting groove 61 and the fourth connecting groove 64, which communicate with respective ends of the first suction side back pressure groove 55 positioned in the first suction region that is located above a horizontal line H passing through a rotary center of the rotor 2 such that the vanes 3 therein are likely to retreat into the slits 5 due to gravity when the vane pump 1 is stopped, is set to be larger than the passage sectional area of at least one of the second connecting groove 62 and the third connecting groove 63, which are located below the horizontal line H and do not communicate with the first suction side back pressure groove 55.

Further, the passage sectional areas of the first connecting groove 61 and the fourth connecting groove 64 may be set to be larger than the passage sectional areas of the second connecting groove 62 and the third connecting groove 63. In this case, the passage sectional areas of the first connecting groove 61 and the fourth connecting groove 64 are set to be substantially equal, and the passage sectional areas of the second connecting groove 62 and the third connecting groove 63 are set to be substantially equal.

Hence, when the vane pump 1 is activated, working oil from the first discharge side back pressure groove 56 or the second discharge side back pressure groove 58, which is increased in pressure as the vanes 3 in the first and second discharge regions are pressed into the slits 5 while following the cam surface 4*a*, is encouraged to flow into the first suction side back pressure groove 55 through the first connecting groove 61 or the fourth connecting groove 64 having a comparatively large passage sectional area.

Accordingly, the pressure of the working oil in the first suction side back pressure groove 55 increases quickly, causing the pressure of the working oil in the respective back pressure chambers 6 opposing the first suction side back pressure groove 55 to increase. As a result, the vanes 3 that have retreated into the corresponding slits 5 are caused to project from the slits 5 quickly by the pressure of the working oil in the back pressure chambers 6. Therefore, the operation for defining the pump chamber 7 by causing the tip end portions of the respective vanes 3 to slide against the cam surface 4*a* is performed quickly.

In other words, when the vane pump 1 is activated, the pressure in the first suction side back pressure groove 55 is increased earlier using the pump operation for reducing the volume of the back pressure chambers 6 by pressing the vanes 3 in the first and second discharge regions into the slits 5, and in so doing, the vanes 3 that have retreated into the corresponding slits 5 in the first suction region project quickly. As a result, the time required for the pump discharge pressure to rise can be shortened.

Figure 5:
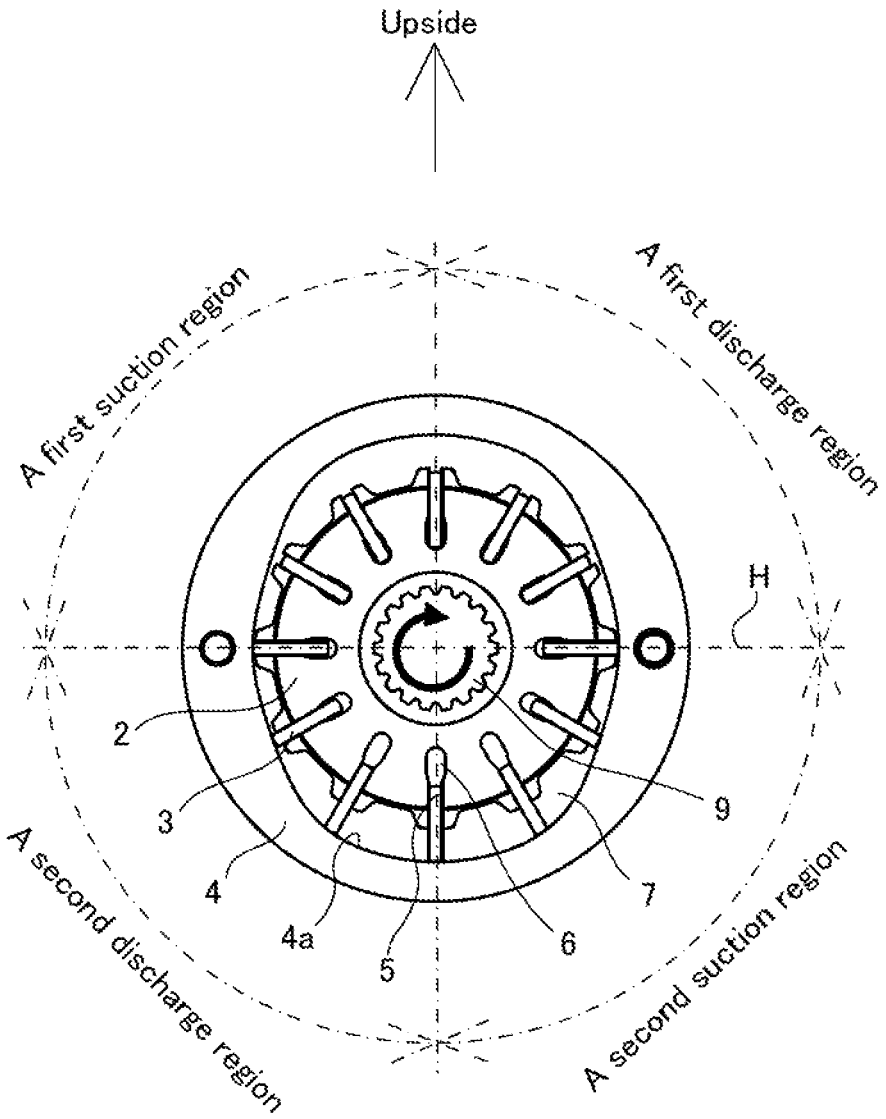
FIG. 5 is a front view showing the condition inside the cam ring when the vane pump according to this embodiment of the invention is installed in a different attitude.
Figure 6:
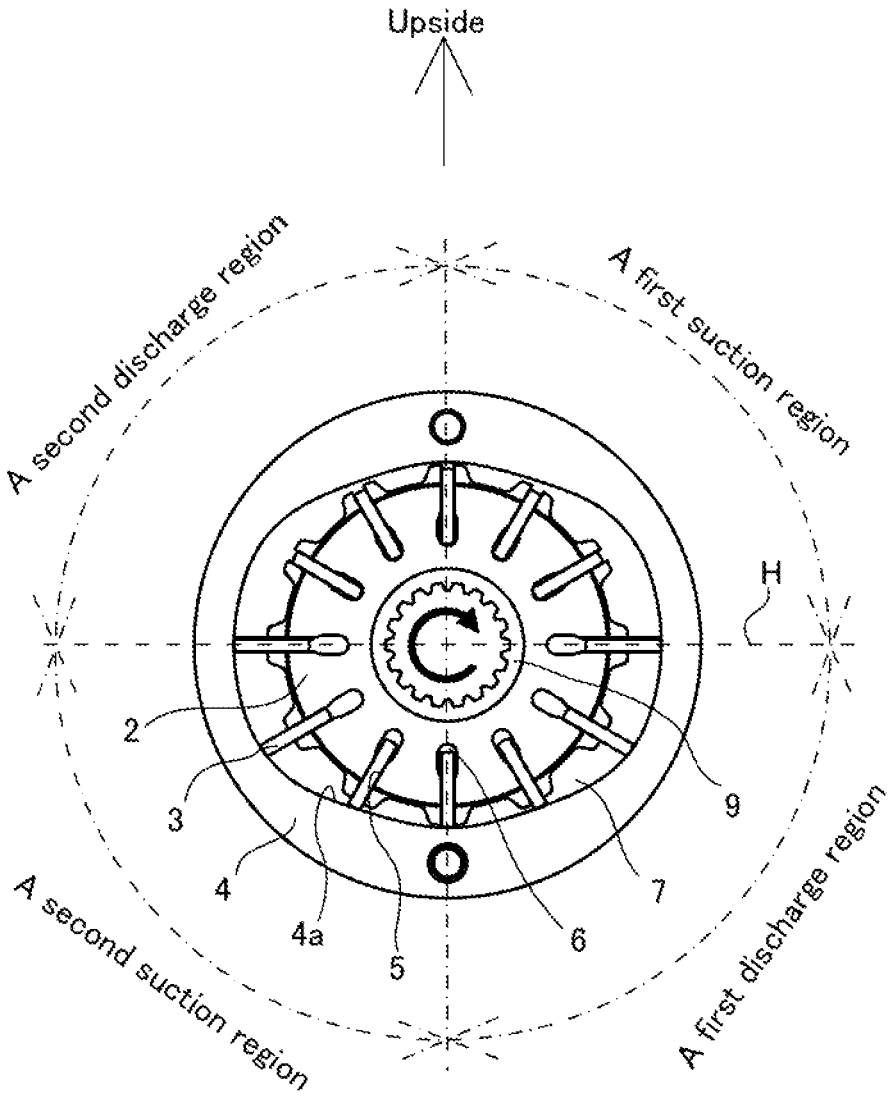
FIG. 6 is a front view showing the condition inside the cam ring when the vane pump according to this embodiment of the invention is installed in a different attitude.

Next, referring to FIGS. 5 and 6, a case in which the vane pump 1 is installed in a different attitude will be described. FIGS. 5 and 6 show a condition inside the cam ring 4 when the vane pump 1 is stopped in a case where the vane pump 1 is installed in a different attitude.

The vane pump 1 shown in FIG. 5 is installed in an orientation whereby a boundary part between the first suction region and the first discharge region is positioned upward, as shown by an arrow in the figure.

As shown in FIG. 5, when the vane pump 1 is stopped, all of the vanes 3 positioned in the first suction region and the first discharge region retreat into the corresponding slits 5 due to gravity.

When the vane pump 1 is activated in this case, a pump operation cannot be obtained from behind the vanes 3 in the first discharge region, but the pressure in the first suction side back pressure groove 55 can be increased quickly by performing a pump operation from behind the vanes 3 in the second discharge region. In so doing, the vanes 3 that have retreated into the corresponding slits 5 in the first suction region can be caused to project quickly, and as a result, the time required for the pump discharge pressure to rise can be shortened.

The vane pump 1 shown in FIG. 6 is installed in an orientation whereby a boundary part between the first suction region and the second discharge region is positioned upward, as shown by an arrow in the figure.

As shown in FIG. 6, when the vane pump 1 is stopped, all of the vanes 3 positioned in the first suction region and the second discharge region retreat to an inner back side of the corresponding slits 5 due to gravity.

When the vane pump 1 is activated in this case, a pump operation cannot be obtained from behind the vanes 3 in the second discharge region, but the pressure in the first suction side back pressure groove 55 can be increased quickly by performing a pump operation from behind the vanes 3 in the first discharge region. In so doing, the vanes 3 that have retreated into the corresponding slits 5 in the first suction region can be caused to project quickly, and as a result, the time required for the pump discharge pressure to rise can be shortened.

According to the embodiment described above, the following effects are obtained.

The connecting grooves 61, 64 that communicate with the back pressure groove 55 positioned in the suction region formed above the rotary center of the rotor 2 are formed to have a larger passage sectional area than the connecting grooves 62, 63 that communicate with the back pressure groove 57 positioned in the suction region formed below the rotary center of the rotor 2. Therefore, the vanes 3 that have retreated into the slits 5 due to gravity during a stoppage are encouraged to projects from the slits 5 by the pump operation performed from behind the vanes 3 during activation. As a result, the pump discharge pressure rises quickly, leading to an improvement in a startability of the vane pump 1.

Further, the pair of connecting grooves 61, 64 that communicate with either end of the back pressure groove 55 positioned in the suction region formed above the rotary center of the rotor 2 are formed to have a larger passage sectional area than the pair of connecting grooves 62, 63 that communicate with the back pressure groove 57 positioned in the suction region formed below the rotary center of the rotor 2. Therefore, the attitude of the vane pump 1 is not limited to a narrow range, and as a result, installation restrictions in a vehicle or the like can be reduced.

The connecting groove 61 that communicates with the back pressure groove 55 formed in the pump cover 50 and positioned in the suction region formed above the rotary center of the rotor 2 is formed to have a larger passage sectional area than the connecting groove 62 that communicates with the back pressure groove 57 formed in the pump cover 50 and positioned in the suction region formed below the rotary center of the rotor 2. Therefore, in contrast to the back pressure grooves 35, 37 formed in the side plate 30, the back pressure grooves 55, 57 formed in the pump cover 50 do not communicate with the high pressure chamber via the short high pressure chamber connecting holes 15, 17, and as a result, the pressure in the back pressure grooves 55, 57, which is raised by the pump operation performed from behind the vanes 3 to expand and reduce the volume of the respective back pressure chambers 6, is prevented from escaping into the high pressure chamber.

Hence, when the vane pump 1 is activated, the vanes 3 are encouraged to project from the slits 5 by the pump operation performed from behind the vanes 3. As a result, the pump discharge pressure rises quickly, leading to an improvement in startability.

In another embodiment, the passage sectional area of the fourth connecting groove 64 may be formed to be larger than the respective passage sectional areas of the first connecting groove 61, the second connecting groove 62, and the third connecting groove 63.

In this case, in the respective installation conditions shown in FIGS. 4 to 6, the pressure in the first suction side back pressure groove 55 is increased earlier by a pump operation performed from behind the vanes 3 in the second discharge region. In so doing, the vanes 3 that have retreated into the corresponding slits 5 in the first suction region can be caused to project quickly, and as a result, the time required for the pump discharge pressure to rise can be shortened.

It should be noted that in the installation condition shown in FIG. 6, even during a stoppage in which the working oil in the second discharge region flows out due to gravity, the second discharge region is filled with working oil when the rotor 2 rotates substantially 90 degrees after the vane pump 1 is activated. Therefore, the pressure in the first suction side back pressure groove 55 can be increased quickly by the pump operation performed from behind the vanes 3 in the second discharge region.

Further, in this embodiment, the connecting groove 64 positioned on a front side in a rotation direction of the rotor 2, from among the two connecting grooves 61, 64 that communicate with the respective ends of the back pressure groove 55 formed in the suction region formed above the rotary center of the rotor 2, is formed to have a larger passage sectional area than the connecting groove 61 positioned on a rear side in the rotation direction of the rotor 2.

In the embodiment described above, when the passage resistance of the first connecting groove 61 or the fourth connecting groove 64 opposing the front side end surface of the rotor 2 is smaller than the passage resistance of the second connecting groove 62 or the third connecting groove 63 opposing the front side end surface of the rotor 2, a difference occurs in the pressure of the working oil exerted on the rotor 2 from the first connecting groove 61, the second connecting groove 62, the third connecting groove 63, and the fourth connecting groove 64. As a result of this differential pressure in the working oil, a difference occurs between the pressure in the first discharge side back pressure groove 56 and the pressure in the second discharge side back pressure groove 58. As a result of this differential pressure, a force for inclining a rotary central axis acts on the rotor 2.

However, by distributing the respective passage sectional areas of the first connecting groove 61, the second connecting groove 62, the third connecting groove 63, and the fourth connecting groove 64 to be symmetrical about the rotary central axis of the rotor 2, a back pressure balance can be realized in the rotor 2.

More specifically, the fourth connecting groove 64 and the second connecting groove 62 are formed to have a larger passage sectional area than the first connecting groove 61 and the third connecting groove 63. The second connecting groove 62 and the fourth connecting groove 64 opposing each other about the rotary central axis of the rotor 2 are formed to have identical passage sectional areas. Similarly, the first connecting groove 61 and the third connecting groove 63 opposing each other about the rotary central axis of the rotor 2 are formed to have identical passage sectional areas.

With the configuration described above, in the installation conditions shown in FIGS. 4 and 5, the passage sectional area of the fourth connecting groove 64 is larger than the passage sectional area of the third connecting groove 63, and therefore the passage resistance of the fourth connecting groove 64 is smaller than the passage resistance of the third connecting groove 63. Hence, when the vane pump 1 is activated, the working oil from the second discharge side back pressure groove 58, which is increased in pressure as the vanes 3 in the second discharge region are pressed into the slits 5, is encouraged to flow into the first suction side back pressure groove 55 through the fourth connecting groove 64 having a comparatively large passage sectional area.

In other words, when the vane pump 1 is activated, the pressure in the first suction side back pressure groove 55 is increased earlier using the pump operation for reducing the volume of the back pressure chambers 6 by pressing the vanes 3 in the second discharge region into the slits 5. In so doing, the vanes 3 that have retreated into the corresponding slits 5 in the first suction region project quickly, and as a result, the time required for the pump discharge pressure to rise can be shortened.

Furthermore, at this time, respective rotor side opening areas of the second connecting groove 62 and the fourth connecting groove 64, which are positioned on an identical straight line that is orthogonal to the rotary central axis of the rotor 2, are formed to be equal, and respective rotor side opening areas of the first connecting groove 61 and the third connecting groove 63 are also formed to be equal. As a result, equal pressure is exerted on the rotor 2 by the working oil in the first connecting groove 61, the second connecting groove 62, the third connecting groove 63, and the fourth connecting groove 64.

Accordingly, the pressure of the first suction side back pressure groove 55 is equal to the pressure of the second suction side back pressure groove 57, and the pressure of the first discharge side back pressure groove 56 is equal to the pressure of the second discharge side back pressure groove 58. Hence, balance can be achieved in the working oil pressure acting on the front side end surface of the rotor 2, and therefore inclination of the central axis of the rotor 2 can be suppressed. As a result, a seizure occurring in a sliding portion due to inclination of the rotor 2 can be prevented.

Although the invention has been described above with reference to certain embodiments, the invention is not limited to the embodiments described above. Modifications and variations of the embodiments described above will occur to those skilled in the art, within the scope of the claims.

The contents of Tokugan 2010-237920, with a filing date of Oct. 22, 2010 in Japan, are hereby incorporated by reference.

The embodiments of this invention in which an exclusive property or privilege is claimed are defined as follows:

The invention claimed is:

1. A vane pump configured as a fluid pressure supply source, the vane pump comprising:

a cam ring having a cam surface formed on an inner periphery thereof;

a rotor provided to face the inner periphery of the cam ring and to be driven to rotate relative to the cam ring;

a plurality of slits formed in a radial shape in an outer periphery of the rotor;

a plurality of vanes having respective base end portions inserted slidably into the slits such that respective tip end portions of the vanes slidably engage against the cam surface, wherein the base end portions of the vanes are opposite to the respective tip end portions;

a side plate;

a pump cover, wherein the side plate and the pump cover sandwich the rotor and the vanes;

a plurality of pump chambers defined between the cam surface and the rotor by the vanes;

a plurality of back pressure chambers defined between the respective base end portions of the vanes and the slits, the back pressure chambers configured to bias the vanes toward the cam surface;

a plurality of back pressure grooves formed in end surfaces of the side plate and the pump cover against which the rotor is configured to slide, the plurality of back pressure grooves configured to communicate with the back pressure chambers as the rotor rotates; and a plurality of connecting grooves formed in the end surfaces of the side plate and the pump cover against which the rotor is configured to slide, the plurality of connecting grooves connecting the plurality of back pressure grooves that are adjacent in a circumferential direction of the rotor to each other, wherein a first connecting groove of the plurality of connecting grooves has a larger passage sectional area than a second connecting groove of the plurality of connecting grooves, the second connecting groove different from the first connecting groove, the first connecting groove communicates with a first back pressure groove of the plurality of back pressure grooves formed in the pump cover, the first back pressure groove is positioned in a suction region above a rotary center of the rotor so as to suction a working fluid into the pump chambers, the second connecting groove communicates with a second back pressure groove of the plurality of back pressure grooves formed in the pump cover, the second back pressure groove different from the first back pressure groove, and the second back pressure groove is positioned in another suction region below the rotary center of the rotor.

2. The vane pump as defined in claim 1, wherein the plurality of connecting grooves further comprise third and fourth connecting grooves, and the first and third connecting grooves, that communicate with respective ends of the first back pressure groove, have a larger passage sectional area than the second and fourth connecting grooves, that communicate with respective ends of the second back pressure groove.

3. The vane pump as defined in claim 1, wherein, the plurality of connecting grooves further comprise a third connecting groove, the first and third connecting grooves communicate with respective ends of the first back pressure groove, and one of the first and third connecting grooves is positioned upstream in a rotation direction of the rotor and has a larger passage sectional area than the other of the first and third connecting grooves which is positioned downstream in the rotation direction of the rotor.

4. The vane pump as defined in claim 3, wherein, among the plurality of connecting grooves, connecting grooves that oppose each other about the rotary center of the rotor are formed with identical passage sectional areas.

5. The vane pump as defined in claim 1, further comprising:

a high pressure chamber to which a pump discharge pressure is led, wherein the side plate is positioned between the rotor and the high pressure chamber; and a high pressure chamber connecting hole formed in the side plate to communicate with the high pressure chamber, wherein the back pressure grooves formed in the side plate communicate with the high pressure chamber via the high pressure chamber connecting hole, and the back pressure grooves formed in the pump cover communicate with the high pressure chamber via the back pressure chambers, the back pressure grooves formed in the side plate, and the high pressure chamber connecting hole.

* * * * *